US011529553B2

(12) United States Patent
German et al.

(10) Patent No.: US 11,529,553 B2
(45) Date of Patent: Dec. 20, 2022

(54) PORTABLE SCOREBOARD

(71) Applicant: 2J Innovations, LLC, Sulphur, LA (US)

(72) Inventors: Josh German, Sulphur, LA (US); Kellie German, Sulpher, LA (US); Fabo Huang, Fujian (CN)

(73) Assignee: 2J INNOVATIONS, LLC, Sulphur, LA (US)

( * ) Notice: Subject to any disclaimer, the term of this patent is extended or adjusted under 35 U.S.C. 154(b) by 236 days.

(21) Appl. No.: 16/743,084

(22) Filed: Jan. 15, 2020

(65) Prior Publication Data

US 2020/0238155 A1 Jul. 30, 2020

Related U.S. Application Data

(60) Provisional application No. 62/796,836, filed on Jan. 25, 2019.

(51) Int. Cl.
*A63B 71/06* (2006.01)

(52) U.S. Cl.
CPC ..... *A63B 71/0669* (2013.01); *A63B 2225/20* (2013.01); *A63B 2225/50* (2013.01)

(58) Field of Classification Search
CPC ..... A63B 71/0669; A63B 2225/20; A63B 2225/50; A63B 7/10672; A63B 7/0669
See application file for complete search history.

(56) References Cited

U.S. PATENT DOCUMENTS 700,738 A * 5/1902 Carter ..... A63B 71/0672 235/125
2,115,770 A * 5/1938 Hartzell ..... G09F 11/12 40/526
3,246,411 A * 4/1966 Aafedt ..... A63B 71/0672 116/222
5,586,707 A * 12/1996 Haskell ..... A63B 71/0672 224/675
5,620,099 A * 4/1997 Bickett ..... A63B 71/06 116/222
6,041,934 A * 3/2000 Alexson ..... G09F 11/06 40/607.14
6,816,130 B1 * 11/2004 Shishido ..... A63B 71/06 345/1.3
7,117,619 B1 * 10/2006 Huber ..... A63B 71/0672 40/604
7,404,373 B2 * 7/2008 Bailey ..... A63B 71/0672 116/318
7,665,888 B2 * 2/2010 Weinstein ..... G04G 9/0064 40/493

(Continued)

*Primary Examiner* — Daniel I Walsh
(74) *Attorney, Agent, or Firm* — Kean Miller LLP; Russel O. Primeaux; Lauren J. Rucinski

(57) ABSTRACT

A Portable Scoreboard that is capable of displaying critical information about the game in real time, either through manual input or through a Wi-Fi connected device. In the preferred embodiment, the Portable Scoreboard is made of light weight, pliable, and waterproof material. In one or more embodiments, the Portable Scoreboard comprises multiple lights to ensure its visibility and may further comprise a solar charging grid for lengthy outdoor events and continuous battery charging. In other embodiments, the Portable Scoreboard may be plugged in to an electrical source for recharging and/or power.

9 Claims, 5 Drawing Sheets

(56) References Cited

U.S. PATENT DOCUMENTS

| | | | | |
|---|---|---|---|---|
| 7,841,117 | B2 * | 11/2010 | Smith | G09F 7/18 40/604 |
| 8,763,552 | B2 * | 7/2014 | Holbrook | A63B 71/0672 116/223 |
| 9,305,473 | B1 * | 4/2016 | Alunni | G09F 21/048 |
| 10,376,766 | B2 * | 8/2019 | Stanfield | A63B 71/0669 |
| 11,033,795 | B1 * | 6/2021 | Berrios | A63B 71/0672 |
| 2007/0125679 | A1 * | 6/2007 | Smith | B65D 75/367 206/462 |
| 2007/0252009 | A1 * | 11/2007 | Kingsborough | B42D 15/045 235/487 |
| 2009/0078605 | A1 * | 3/2009 | Wirth, Jr. | B65D 27/16 53/462 |
| 2009/0223433 | A1 * | 9/2009 | Cowen | A63B 71/0616 116/222 |
| 2011/0062242 | A1 * | 3/2011 | Cowcher | G06K 19/07327 235/492 |
| 2012/0256373 | A1 * | 10/2012 | Tam | A63D 15/20 273/148 R |
| 2013/0240629 | A1 * | 9/2013 | Pesonen | G06K 13/06 248/316.4 |
| 2015/0220913 | A1 * | 8/2015 | Liu | G06K 19/0708 235/492 |
| 2017/0286285 | A1 * | 10/2017 | Berke | G06F 12/0804 |
| 2018/0028895 | A1 * | 2/2018 | Stanfield | H01M 50/296 |
| 2018/0280783 | A1 * | 10/2018 | Gordon | G06F 3/0488 |
| 2022/0162892 | A1 * | 5/2022 | Mitsui | F16C 11/04 |

* cited by examiner

PORTABLE SCOREBOARD

CROSS REFERENCE TO RELATED APPLICATIONS

This application claims priority to U.S. provisional application No. 62/796,836 entitled "Portable Scoreboard" and filed on Jan. 25, 2019.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BRIEF SUMMARY OF THE INVENTION

This invention addresses the need for a multi-purpose, portable scoreboard for use at, for example, sporting events. The scoreboard comprises a plurality of panels with displays. The displays provide information on the score of the game, the time, and other key statistics, at a user's preference. The panels are connected through a locking means and flexible connecting member. The lock means and flexible connecting member allow the panels to be folded on top of one another in a stacked position for ease of storage and transportation.

DESCRIPTION OF THE DRAWINGS

The drawings constitute a part of this specification and include exemplary embodiments of the Portable Scoreboard, which may be embodied in various forms. It is to be understood that in some instances, various aspects of the invention may be shown exaggerated or enlarged to facilitate an understanding of the invention. Therefore the drawings may not be to scale.

BACKGROUND

Figure 1:
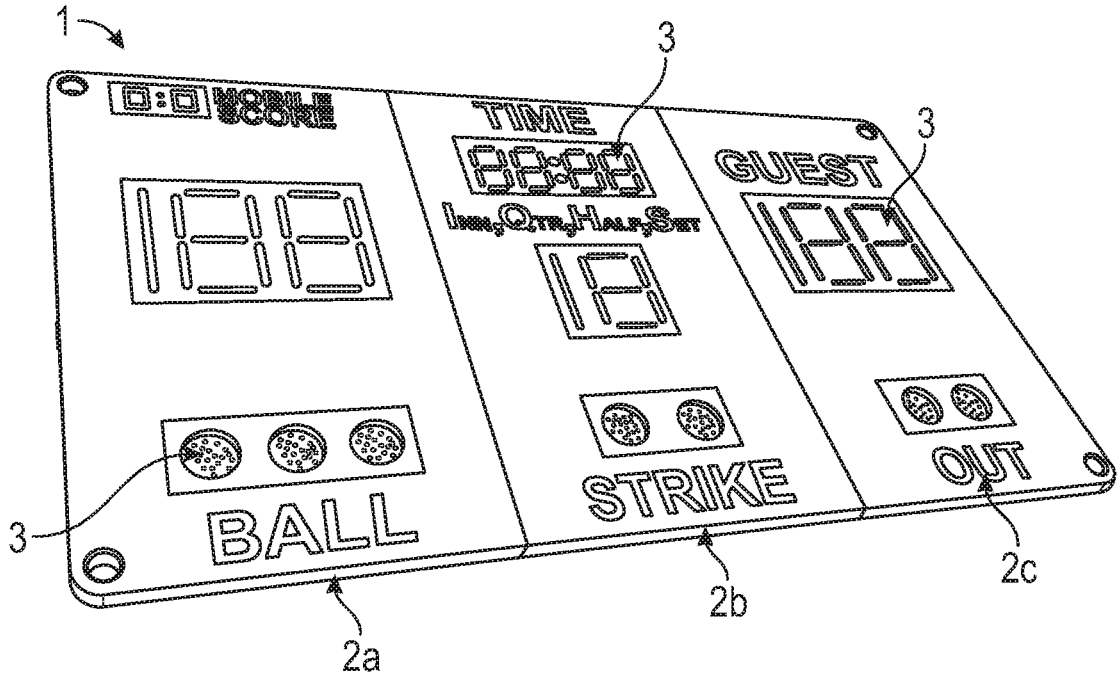
FIG. 1 is one embodiment of the Portable Scoreboard in the locked position.

Sporting events are a so interwoven into the fabric of today's society that it would be hard to imagine life without such a pastime. Games such as football, baseball, soccer, and basketball—just to name of few—provide both a collegial and competitive experience for the fans and players alike. In most instances, the score of the game is the competitive pinnacle. Thus, keeping track of the score informs the fans of the progress of their team and provides the players and coaches with critical information for strategy decisions.

Other information, such as the strike count in baseball, the time left in the period for basketball, and the current yard line in football are equally critical. Therefore, many sporting event venues include a scoreboard to apprise the fans and players of vital information as the game or match progresses.

However, some sporting event venues, especially for juvenile or amateur level events, do not have scoreboards. This leaves the crowd, players, and coaches left with guessing at the score or having to resort to taking meticulous notes instead of focusing on enjoying or playing the game. For example, most little league baseball fields do not contain scoreboards. The parent audience must take it upon themselves to keep track of and announce the score to the detriment of enjoying their child play baseball. And, many little league teams compete on a traveling basis so that some fields may have scoreboards while others do not. This leaves the parents and players in the lurch if a field does not contain a scoreboard. A similar problem is noticed across all sports and at various level of skill.

The present invention addresses these problems by providing for a portable scoreboard. The Portable Scoreboard is capable of displaying critical information about the game in real time, either through manual input or through a Wi-Fi connected device. In the preferred embodiment, the Portable Scoreboard is made of light weight, pliable, and waterproof material. In one or more embodiments, the Portable Scoreboard comprises multiple lights to ensure its visibility and may further comprise a solar charging grid for lengthy outdoor events and continuous battery charging. In other embodiments, the Portable Scoreboard may be plugged in to an electrical source for recharging and/or power.

DETAILED DESCRIPTION

The subject matter of the present invention is described with specificity herein to meet statutory requirements. However, the description itself is not intended to necessarily limit the scope of claims. Furthermore, the described features, structures, or characteristics may be combined in any suitable manner in one or more embodiments. One skilled in the relevant art will recognize, however, that the Portable Scoreboard may be practiced without one or more of the specific details, or with other methods, components, materials, and so forth. In other instances, well-known structures, materials, or operations are not shown or described in detail to avoid obscuring aspects of the invention.

Figure 6:
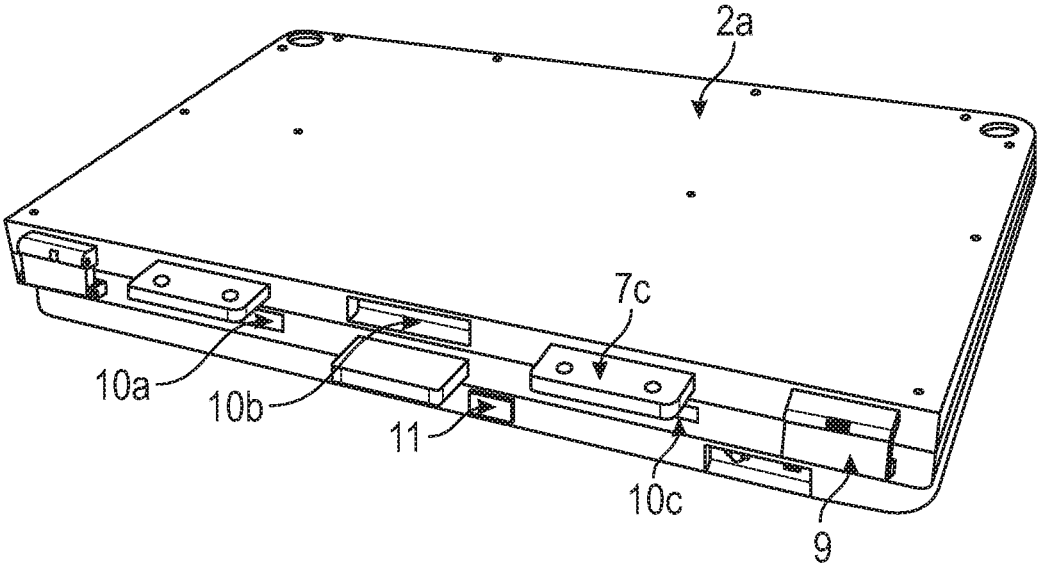
FIG. 6 is one embodiment of the Portable Scoreboard in the stacked position.

The present invention is a portable scoreboard that can be used for a variety of sporting events and other applications. The scoreboard can be placed in the locked position (FIG. 1), the locked and upright position (FIG. 2), or the stacked position (FIG. 6). The Portable Scoreboard comprises a plurality of panels 2. As depicted in one embodiment in FIG. 1, there are three panels 2*a*, 2*b*, 2*c*. However, the Portable Scoreboard 1 may have a varying number of panels depending on the application. In some embodiments, there are two panels. In other embodiments there are four panels. In other embodiments still, there may be five panels, up to any number of panels desired by the user. In each embodiment, the number of panels 2 may be interchangeable so that, for example, the Portable Scoreboard 1 may comprise five panels with any number of panels from one to five comprising the Portable Scoreboard 1 in the locked position.

Suitably, the panels 2 are the same shape and size. However, in some embodiments the panels may be varying in length, width, and shape.

The plurality of panels 2*a*—c comprise a material suitable for ease of mobility. In one embodiment, the panels are made of lightweight plastic such as polyvinyl chloride (PVC). In other embodiments the panels are made of polycarbonate. In one or more embodiments, the panels 2 are made of waterproof material.

The Portable Scoreboard further comprises a plurality of displays. 3. As depicted in FIG. 1, the displays provide information on the score of the game, the time, and other key statistics. FIG. 1 is only one embodiment of the Portable Scoreboard. The number of displays 3 and information displayed will vary based on user preference. Additionally, the Portable Scoreboard may further comprise permanent indicia or lettering. Such indicia or lettering may indicate, show, define, identify, etc. the displays. They may also show the name of the team, type of sport, or any other pertinent information.

In some instances, certain displays 3 and/or indicia may be unused. For example, during a soccer game, the "strike" or "out" displays 3 and indicia are not necessary.

In one embodiment, the Portable Scoreboard uses electromechanical or electronic means of displaying the score. Such electronic means may comprise a plurality of large dot-matrices, incandescent bulbs, light emitting diodes, or electromechanical flip segments, or any other display method as known in the art.

The Portable Scoreboard 1 displays 3 are controlled by the user. The user may manually change the display through controls on the Portable Scoreboard itself or a connected device. In one or more embodiments, the displays 3 are controlled by the user with a Wifi or Bluetooth enabled device, for example, a smart phone or tablet.

Figure 2:
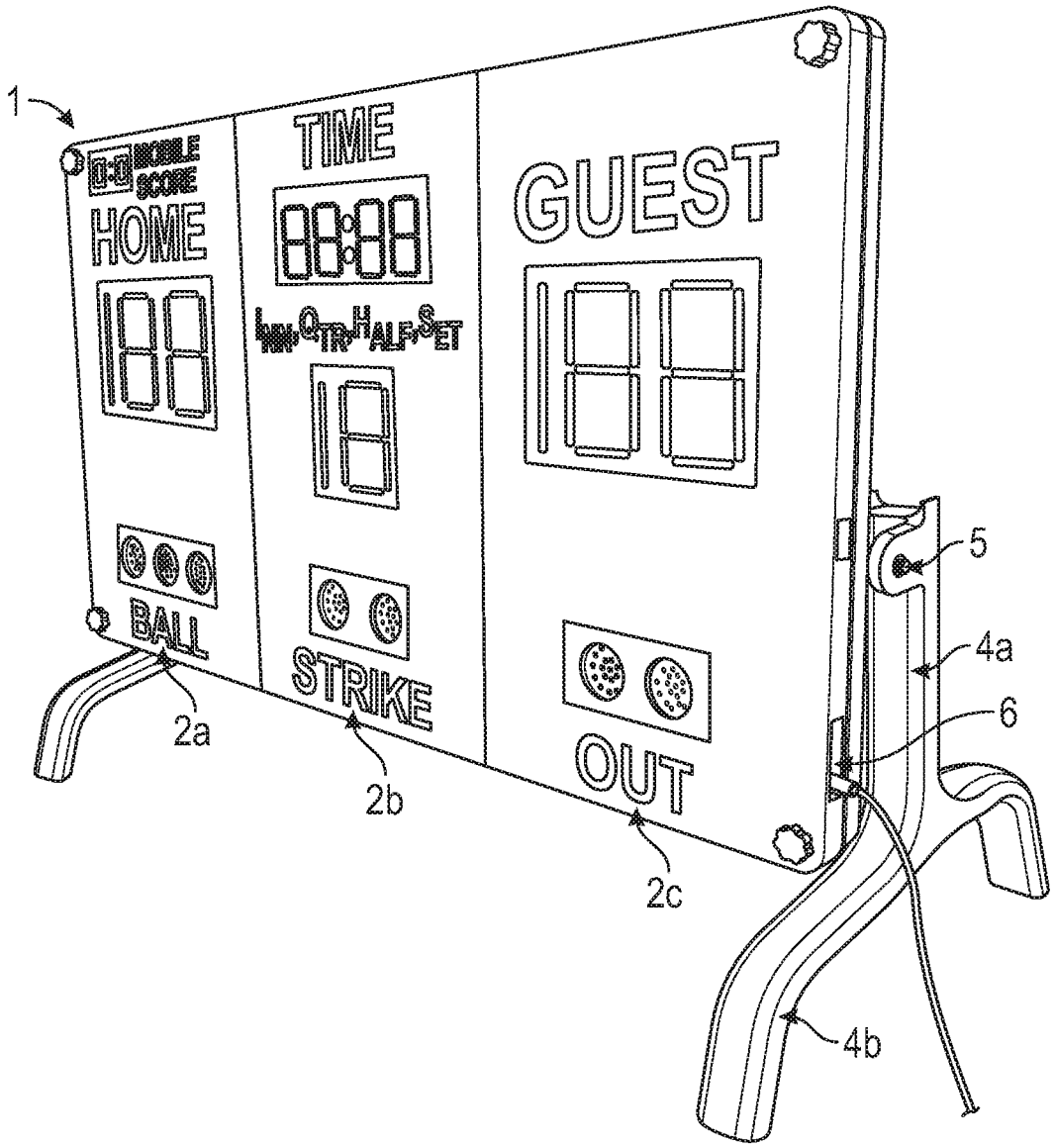
FIG. 2 is one embodiment of the Portable Scoreboard in the locked and upright position.

FIG. 2 depicts the Portable Scoreboard 1 in the upright and locked position. The Portable Scoreboard further comprises a stand 4 and a stand connecting device 5. In the depicted embodiment, the stand further comprises a vertical member 4*a* and one or more legs 4*b*. The stand 4 is designed so that the weight of the Portable Scoreboard 1 is full supported. The stand connecting device 5 may comprise a bolt and corresponding fitting on the vertical member 4*a* and the back of the Portable Scoreboard 1. However, any connecting means suitable for attaching the Portable Scoreboard 1 may be used. In one or more embodiments, the Portable Scoreboard 1 is connected to the stand 4 so as to allow the Portable Scoreboard 1 to rotate. In one or more embodiments, the stand is removably attached to that so that the user may remove the stand 4 when transporting the Portable Scoreboard 1.

Figure 3:
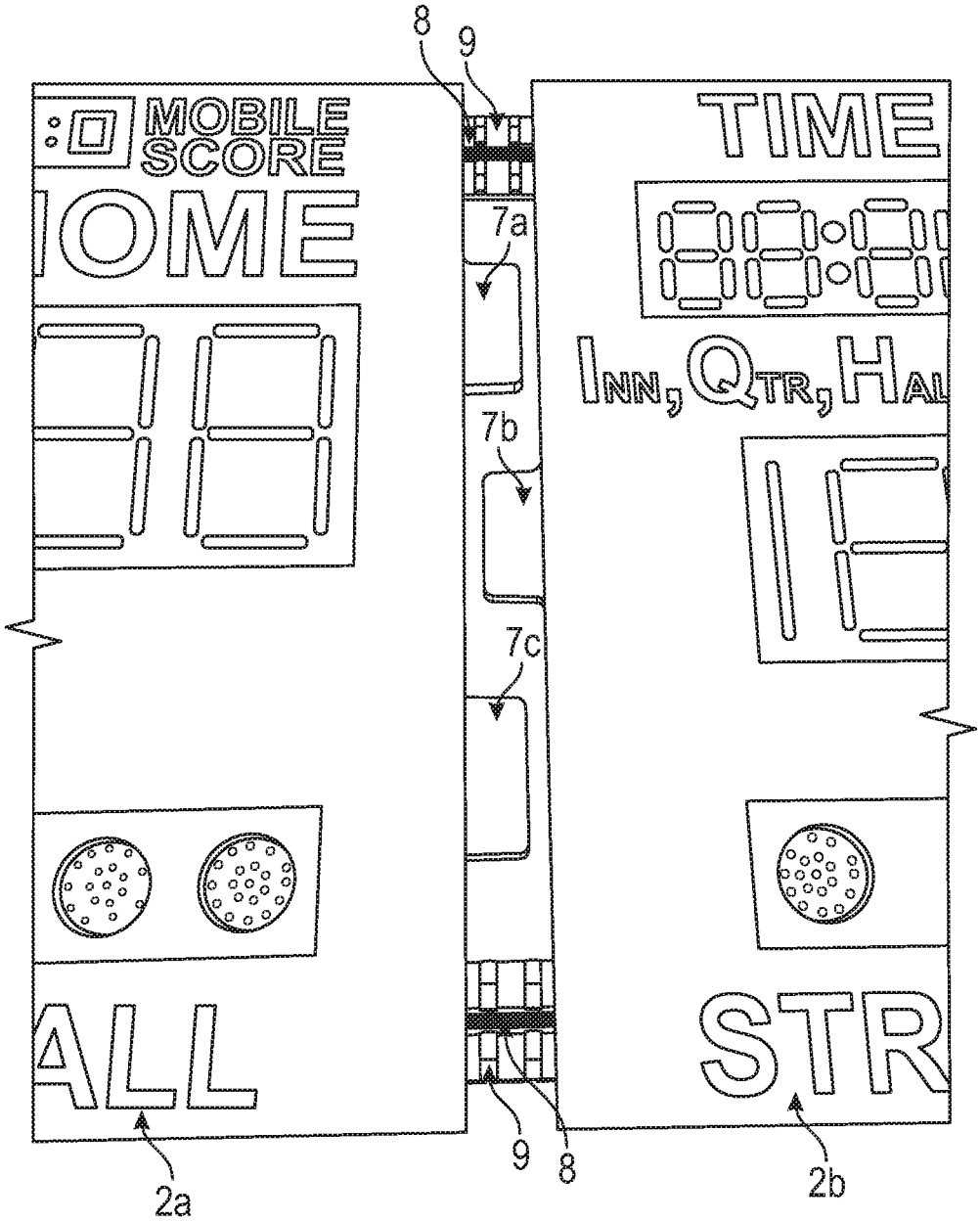
FIG. 3 is one embodiment of the Portable Scoreboard depicting the locking means.

FIGS. 3-6 depict the locking means 7 and flexible connecting member 9. The locking means 7 and flexible connecting member 9 allow the panels 2 of the Portable Scoreboard 1 to be folded on top of one another in the stacked position. The embodiment of FIG. 3 depicts the locking means 7 as three separate, rigid inserts 7*a*, 7*b*, 7*c* connected or integrated in the sides of the panels 2. As depicted, two inserts are connected or integrated into the interior sides of panel 2*a* while one insert is connected or integrated into the receiving side of panel 2*b* that faces 2*a*. However, any suitable combination of and number of inserts 7 per panel 2 may be used. Not pictured, panel 2*c* comprises similar inserts 7 on its interior side facing panel 2*b*.

The inserts 7 correspond to openings 10 in the adjacent panel. As depicted in FIGS. 3-6, when the panels are in the locked (or locked and upright) position, the inserts 7 of one panel 2*a* are inserted into the corresponding openings 10*a*, 10*c* of the adjacent panel. To move the panels 2 from a locked position (FIGS. 3, 4, 5), the panels 2 are moved apart and the inserts 7 are removed from the corresponding openings 10. This allows the panels to be moved into the stacked position (FIG. 6).

Figure 4:
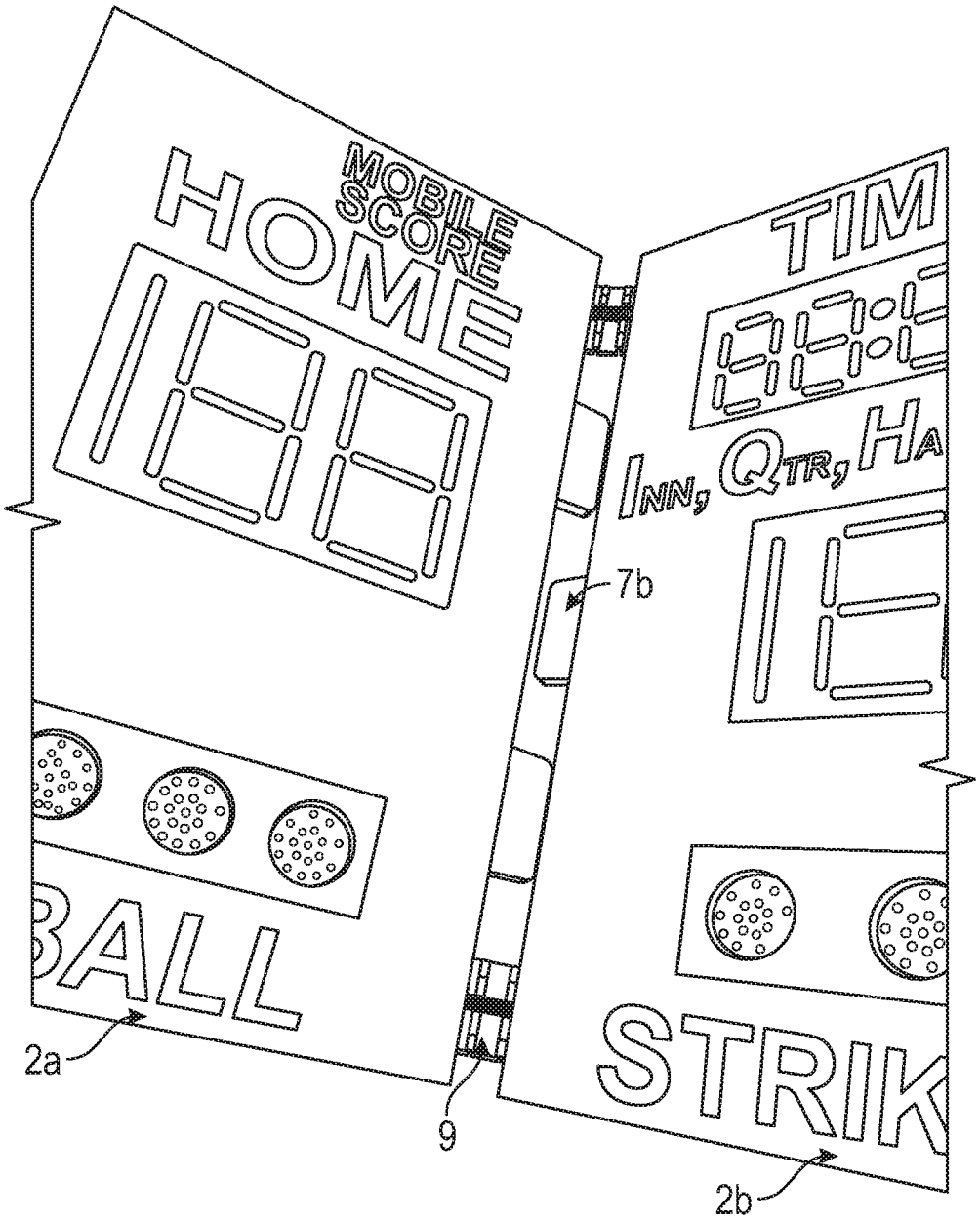
FIG. 4 is one embodiment of the Portable Scoreboard depicting the transition from the locked position to the stacked position.
Figure 5:
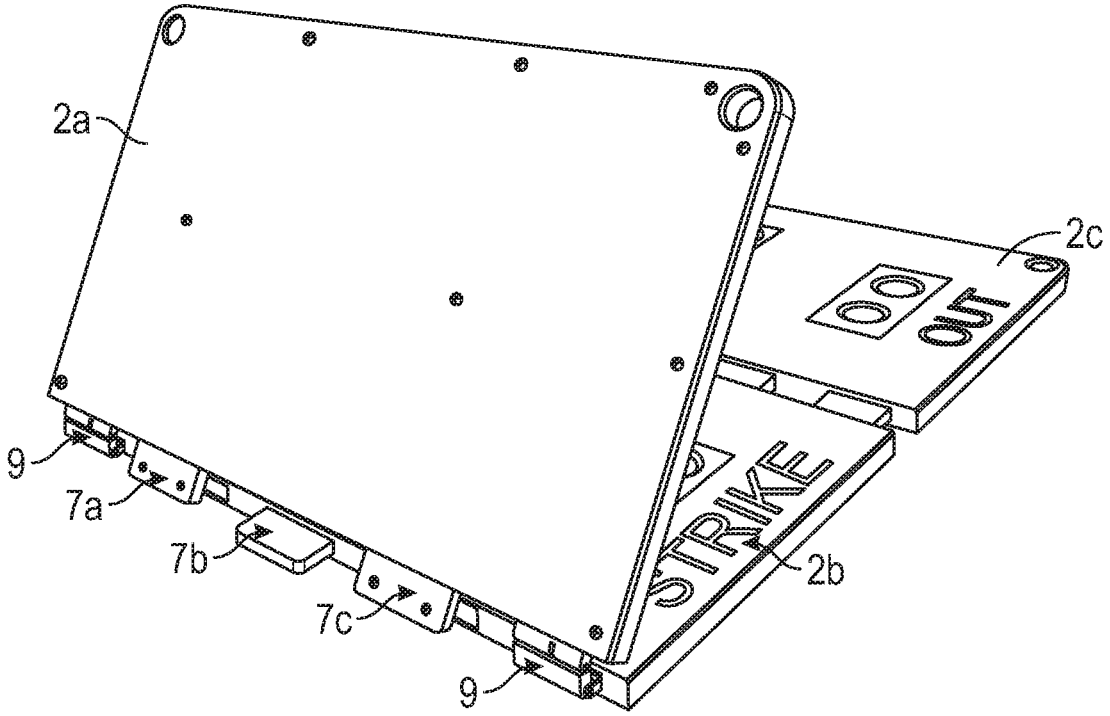
FIG. 5 is one embodiment of the Portable Scoreboard depicting a side view of the transition for the locked position to the stacked position.

In order to keep the panels 2 together and the inserts 7 aligned with the corresponding openings 10 when moving the panels 2 from a locked (or locked and upright) and stacked position, the Portable Scoreboard may suitably comprise at least one flexible connecting member 9. The flexible connecting member is suitable permanently attached to said panels 2. As depicted in FIGS. 3 and 4, the Portable Scoreboard comprises two flexible connecting members 9. Each flexible connecting member 9 is connected at one end to one panel 2*a* and at the other end to the adjacent panel 2*b*. Any pliable material with a high fatigue tolerance suitable for connecting the panels 2 may be used. In one or more embodiments, a flexible plastic is used. In other embodiments stainless steel is used.

The flexible connecting member 9 may also be used in conjunction with a spring type member 8. In those embodiments, the spring type member 8 provides further support for the flexible connecting member 9 and allows the panels 2 to be folded on top of each other in the stacked position, in such a way that the corners of the panels 2 are aligned as depicted in FIG. 6. The spring type member 8 also allows for the panels to be pulled apart and away from each other during the transition for the locked (or locked and upright) and stacked positions. Any suitable spring may be used as known in the art.

In addition to connecting members 9 disclosed herein, in alternative embodiments connecting members 9 may comprise hooks, Velcro(R), double-sided tape, glue, magnets, bungies, slotted sides and other connecting means known to those skilled in the art.

The Portable Scoreboard 1 may be connected to a power source. In one or more embodiments, the power source comprises an electrical outlet connection, a battery, a set of solar panels, or some combination thereof as known in the art.

For the purpose of understanding the Portable Scoreboard references are made in the text to exemplary embodiments of the Portable Scoreboard, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

The invention claimed is:

1. A portable scoreboard comprising:

a. two adjacent panels, comprising a left panel and a right panel, each each one of the left and right panels comprising at least one opening;

b. at least one insert integrally connected to each of said panels, wherein said at least one insert has a corresponding size and shape configured to be fit inside said at least one opening of each of said left and right panel, wherein said at least on one opening said left panel physically interacts with said at least one insert on said right panel and said at least one opening on said right panel physically interacts with said at least one insert on said left panel such that said at least one insert on said right panel fits inside said at least one opening on said left panel and said at least one insert on said left panel fits in said at least one opening on said right panel;

c. at least one flexible connecting member that connects each of said left and right panels together so so that said at least one insert on each of said two panels may be fitted inside said at least one opening on each of said two panels and wherein upon removal of each of said inserts from each of said openings, each of said panels remain connected by the flexible connecting member; and d. at least one electronic score display on at least one of said panels.

2. The portable scoreboard of claim 1 further comprising a stand removably attached to said plurality of panels.

3. The portable scoreboard of claim 1 wherein said plurality of panels comprises a lightweight, waterproof material.

4. The portable scoreboard of claim 1 wherein said at least one display is controlled via a Wi-Fi enabled device.

5. The portable scoreboard of claim 4 wherein said Wi-Fi enabled device is a smart phone.

6. The portable scoreboard of claim 1 wherein said displays further comprise indicia.

7. The portable scoreboard of claim 1 wherein said at least one display is controlled by a Bluetooth connected device.

8. A portable scoreboard comprising three panels, two outer panels and one inner panel, wherein said two outer panels each comprise an inner side and an outer side and said inner panel comprises two receiving sides; wherein each of said two outer panels comprise two openings and one insert on said inner side each and said inner panel comprises one opening and two inserts on each of said receiving sides, so that said two openings on said two outer panels inner side physically interact with said two inserts on each of said receiving sides, such that said physically interacting with said two inserts comprises each of said two inserts being fit in said two openings and said one opening on each of said receiving sides of said inner panel physically interact with the inserts on each of said inner sides of each outer panel, such that said physically interacting with said inserts comprises each of the inserts of each outer panel being fit into said one opening on each inner panel; at least one flexible connecting member that connects each of said panels together, wherein upon removal of each of said inserts from each of said openings, each of said panels remain connected to each other by the flexible connecting member; and at least one electronic score display on one of said panels.

9. The portable scoreboard of claim 8 wherein said two outer panels comprise two openings and one insert on said inner side each and said inner panel comprises one opening and two inserts on each of said receiving sides, so that said two openings on said two outer panels inner side correspond to said two inserts on each of said receiving sides and said one opening on each of said receiving sides of said inner panel corresponds to one insert on each of said inner sides of each outer panel.

* * * * *